United States Patent [19]

Leroux et al.

[11] Patent Number: 4,900,585

[45] Date of Patent: Feb. 13, 1990

[54] CATHODE AND PROCESS FOR THE MANUFACTURE THEREOF

[75] Inventors: Francis Leroux, Brignais; Dominique Ravier, Lyon, both of France

[73] Assignee: Atochem, Paris, France

[21] Appl. No.: 145,722

[22] Filed: Jan. 15, 1988

Related U.S. Application Data

[62] Division of Ser. No. 844,709, Mar. 27, 1986, abandoned.

[30] Foreign Application Priority Data

Mar. 29, 1985 [FR] France ..... 85 04738

[51] Int. Cl.[4] ..... B05D 5/12; C25B 11/04

[52] U.S. Cl. ..... 427/77; 427/126.5; 427/343; 204/290 R; 204/292

[58] Field of Search ..... 204/292, 293, 290 R; 502/326; 427/343, 126.5, 126.6, 383.7, 419.2, 126.3

[56] References Cited

U.S. PATENT DOCUMENTS

| | | | |
|---|---|---|---|
| 4,157,943 | 6/1979 | Scarpellino | 204/37 R |
| 4,214,970 | 7/1980 | Spaziante | 204/265 |
| 4,311,569 | 1/1982 | Dempsey | 204/129 |
| 4,392,927 | 7/1983 | Fabian | 204/98 |
| 4,584,085 | 4/1986 | Beaver | 204/290 R |

*Primary Examiner*—John F. Niebling
*Assistant Examiner*—Ben C. Hsing
*Attorney, Agent, or Firm*—Sigalos, Levine & Montgomery, P.C.

[57] ABSTRACT

The process for the manufacture of cathodes suitable for use in electrolysis comprising depositing onto an electrically conductive substrate at least one layer of said Group VIII metal salts, one of which is a platinum group metal and then subjecting the whole to a heat treatment to oxidize said salts to the oxide form.

6 Claims, No Drawings

CATHODE AND PROCESS FOR THE MANUFACTURE THEREOF

This application is a division, of application Ser. No. 844,709, filed Mar. 27, 1986 now abandoned.

BACKGROUND OF THE INVENTION

The present invention relates to new cathodes which can be used in electrolysis. It also relates to a process for the manufacture of such cathodes. It relates especially to cathodes which can be used for the electrolysis of an aqueous solution of an alkali metal halide which is especially remarkable because of the low value of its working potential and the stability of its electrochemical performance with time.

These cathodes belong to the group of activated metal cathodes obtained by coating a cathode substrate by means of various activating materials, the purpose being essentially to reduce the hydrogen overvoltage in an alkaline medium. One of the techniques which can be used; generally known as "high area nickel", consists in forming a coating of microporous nickel on a ferrous substrate by first depositing a nickel-zinc alloy and then removing the zinc. Other techniques consist in depositing certain metal alloys such as nickelmolybdenum alloys (British Patent No. 922,350) on the substrate.

European Patent Application No. 0,129,734 describes cathodes bearing a coating consisting of a mixture of at least one platinum group metal and at least one oxide of a metal of the metal group, the platinum group metal representing 2 to 30% of the weight of the said mixture. Japanese Patent Application published under No. 7/13,189 describes a nickel or nickel alloy cathode bearing a coating consisting of a platinum group metal or an oxide of the said metal.

British Patent No. 1,511,719 describes a cathode comprising a metal substrate, a cobalt coating and a second coating of ruthenium.

U.S. Pat. No. 4,100,049 describes a cathode comprising a substrate and a coating consisting of a mixture of a precious metal oxide and of an oxide of a valve metal, especially zirconium oxide.

Japanese Patent Application published under number 090,080 describes a technique for the manufacture of a cathode consisting in treating a ferrous substrate with perchloric acid and then coating this cathode by sintering active substances comprising ruthenium, iridium, iron and nickel in the form of a metal or a metal compound.

A technique for depositing a coating consisting of a nickel-palladium alloy onto a substrate consisting, for example, of nickel is also described in U.S. Pat. No. 3,216,919. According to this patent, a layer of alloy is applied in powder form to the substrate and then sintering of the said alloy powder is carried out.

Coating of an electrode by electrodeposition of ruthenium-nickel alloy has also been proposed (Russian Pat. No. 264,096).

Japanese Patent Application published under number 110,983 (U.S. Pat. No. 4,465,580) describes a cathode bearing a coating consisting of a dispersion of particles of nickel or of a nickel alloy and an activator consisting of platinum, ruthenium, iridium, rhodium, palladium or osmium or of an oxide of these metals.

Japanese Patent Application published under number 53/010,036 describes a cathode which has a valve metal substrate and a coating of an alloy of at least one platinum group metal and a valve metal and, if appropriate, a surface coating of at least one platinum group metal.

SUMMARY OF THE INVENTION

The present invention provides novel cathodes which can be used especially in the electrolysis of aqueous solutions of alkali metal halides.

Briefly, the present invention comprises a cathode consisting essentially of an electrically conductive substrate bearing a coating consisting essentially of at least two oxides of a metal of Group VIII of the Periodic Classification of the Elements, at least one of which is a platinum group metal.

The invention also relates to the process of making these cathodes as hereinafter set forth.

DETAILED DESCRIPTION

The present invention concerns especially cathodes comprising an electrically conductive substrate and a coating, the said coating consisting of ruthenium oxide ($RuO_2$) associated with one or more iron, cobalt or nickel oxides and, if appropriate, with one or more other oxides of precious metals of Group VIII.

Among such cathodes, the invention relates especially to those in whose coating the ruthenium oxide has a microcrystalline structure and the oxides of the nonprecious metals have a crystalline structure.

The invention concerns especially cathodes in the coating of which some or all of the above-mentioned oxides are in the form of scales.

Within the meaning of the invention, the term "scale" denotes a film which can be planar or in the form of a portion of a cylinder or of a sphere, or the combination of the said shapes, whose thicknesses is less than one-tenth of the mean of the two dimensions of a quadrilateral in which the said scale can be inscribed, the mean value of the said dimensions being capable of being between 1 and 100 microns and more precisely between 3 and 30 microns.

As already indicated, the coating consists wholly or partially of at least one oxide of a platinum group metal; that is to say, ruthenium, rhodium, palladium, osmium, iridium , and platinum. In the invention, preference is given to ruthenium oxide or to a combination of the said oxide with one or more other precious metal oxides of the platinum group.

The molar ratio of the precious and nonprecious metal oxides in the coating of the cathodes according to the invention is generally between 10/1 and 1/10 and preferably between 1/5 and 5/1.

The material forming the substrate can be chosen from electrically conductive materials. It will advantageously be chosen from the group consisting of nickel, stainless steel and mild steel, this list not being restrictive.

The substrate can be in the form of a plate, foil, with or without a certain number of orifices or perforations, a trellis, a metal sheet or expanded metal, grids, the said materials being capable of being planar or cylindrical in shape or having any other shape depending on the technology in use.

The process of the present invention comprises depositing one or more layers of one or more salts of Group VIII metals onto the substrate which has been subjected to a suitable treatment beforehand, if appropriate, and then subjecting the whole to a heat treatment resulting in the oxidized form.

The preliminary treatment of the substrate advantageously consists of a degreasing, if necessary, followed by mechanical and/or chemical scaling, in accordance with methods which are now well known.

One or more layers of a solution or suspension containing all the metal salts (or oxide precursors) can be deposited onto this substrate; it is also possible to deposit these precursors separately as successive layers. It is also possible to deposit one or more layers of a part of the precursors, to produce the decomposition of the precursor after each layer or only after the last layer, and then to repeat the same operation with the other part of the oxide precursors. The preceding description is deliberately brief for the sake of simplicity, but it will be readily appreciated that any combinations of precursors are possible and that, in particular, the same precursor may be present in several layers, either by itself or combined with the same precursor in the different layers or with different precursors from one layer to another.

The above-mentioned precursors are in general deposited in the form of a solution or a suspension. Depending on the nature of the precursor, the solvent or the diluent can be water, an inorganic or organic acid or an organic solvent Preferably, an organic solvent such as dimethylformamide or an alcohol, especially ethanol or 2-ethylhexanol, is used. The metal atom concentration is between $3\times10^{-2}$ and 3 moles/liter and preferably between 1 and 2 moles/liter.

The oxide precursors which can be used in the invention consist generally of inorganic or organic metal salts such as, for example, halides, nitrates, carbonates, sulphates, acetates or acetylacetonates. In the case of platinum and ruthenium oxide precursors, hexachloroplatinic acid hexahydrate and ruthenium chloride hydrate will be used to advantage.

Deposition of the layers of above-mentioned precursors can be effected using conventional methods: immersion of the substrates in the solution or solutions, coating with a paintbrush, brush or the like, or electrostatis spraying.

The preparation of the solutions and the deposition of the said solutions are generally carried out at ambient temperature and in contact with air. Where applicable, if is possible, of course, to raise the temperature, especially to make it easier to dissolve certain precursors and/or to work in an atmosphere of nitrogen or another gas which is unreactive towards the precursors.

The conversion of the precursors to oxides is generally produced by a heat treatment. This treatment is advantageously preceded by treatment in an air oven, intended to remove all or some of the solvent or diluent. This oven treatment can be carried out at a temperature which can attain 200° C., the temperature range from about 100° to 150° C. being especially recommended. The duration of this treatment is generally a few tens of minutes. The heat treatment as such is generally carried out in air at a temperature which varies, depending on the precursors used, between 200° and 1000° C. The operation is preferably carried out at a temperature between 400° and 750° C. This heat treatment generally lasts for between 15 minutes and 1 hour per layer. This heat treatment can be carried out after each oven treatment or after the last oven treatment in the case where several layers are deposited.

The cathode of the invention is suitable for use in electrolysis cells in which water or an aqueous solution is electrolysed and in which electrolysis produces hydrogen which is released at the cathode The cathode is especially suitable for the electrolysis of aqueous solutions of alkali metal chlorides and especially of aqueous solutions of sodium chloride and for the electrolysis of water, for example, in the electrolysis of aqueous solutions of potassium hydroxide. Microporous diaphragms can be used as separators in the electrolysis cells, but the cathodes according to the invention are especially advantageous in membrane technology.

The invention will be further described in connection with the following examples which are set forth for purposes of illustration only.

EXAMPLE 1

The substrate consists of a nickel plate $200\times10\times1$ mm in size and a surface treatment using corundum is applied (mean bead diameter 260 μm).

A solution of 1 g of $RuCl_3.xHCl.yH_2O$, containing approximately 38% by weight of ruthenium metal and 2 g of $Ni(NO_3)_2.6H_2O$ in 2 $cm^3$ of ethanol is prepared at 23°.

The nickel plate is coated with this solution. An oven treatment in air (120° C., 30 min) is applied, followed by a heat treatment in air (500° C., 30 min). After cooling, the coating/oven treatment/heat treatment sequence is repeated twice.

A 1.7 $mg/cm^2$ coating is obtained of a mixture essentially in the form of scales of a mean size between 3 and 30 μn, which show the $RuO_2$ and NiO structures when examined by X ray crystallography. The ruthenium oxide shows a microcrystalline structure and the nickel oxide a crystalline structure.

When tested in sodium hydroxide at a concentration of 450 g/I, at 850° C. and at 50 $A/dm^2$, this cathode has working potential of −1160 mV, with reference to a saturated calomel electrode (S.C.E.).

A coating consisting solely of $RuO_2$ (at a rate of 3 $mg/cm^2$) is deposited under the same conditions for comparison. It is found that the working potential is −1300 mV with reference to the S.C.E.

Furthermore, an 80 mm diameter disc consisting of an expanded and rolled nickel grid, coated with $RuO_2$/NiO in accordance with the process described above, is used as a cathode in a cell for the electrolysis of an aqueous solution of sodium chloride, using membrane technology.

The operating conditions are:

(i) density=30 $A/dm^2$, (ii) temperature=80° C., and (iii) sodium hydroxide 32% by weight.

It is found:

(a) that the voltage at the terminals of this cell shows a gain of 350 mV compared to the voltage at the terminals of a cell in which the cathode consists of uncoated nickel alone, and (b) that this gain is constant at 350 mV after 30 days continuous operation.

EXAMPLE 2

A nickel substrate which has been subjected to a surface treatment under the conditions of Example 1 is used.

Two solutions are prepared at 23° C.:

(i) solution A: solution of 1 g of $RuCl_3.xHCl.yH_2O$ of Example 1 in 1 $cm^3$ of ethanol, and (ii) solution B: a solution of 1 g of $Ni(NO_3)_2.6H_2O$ in 1 $cm^3$ of ethanol.

Two layers of solution B are deposited on the nickel substrate by following the coating/oven treatment/heat treatment sequence of Example 1, and then, after cooling, 1 layer of solution A is deposited, also by following the coating/oven treatment/heat treatment sequence.

This cathode bearing a double coating containing NiO and $RuO_2$ (X ray crystallography) is tested in sodium hydroxide, as in Example 1 and the working potential is −1170 mV with reference to the S.C.E.

EXAMPLE 3

A. CATHODE OF THE PRESENT INVENTION

The nickel substrate and the two solutions A and B of Example 2 are used.

One layer of solution A is first deposited on the nickel (coating/oven treatment/heat treatment sequence of Example 1) followed, after cooling, by 2 layers of solution B (also the coating/oven treatment/heat treatment sequence of Example 1).

This cathode, bearing a double coating containing $RuO_2$ and NiO has a working potential of −1190 with reference to the S.C.E. (test in the sodium hydroxide of Example 1).

B. COMPARATIVE EXAMPLE

Three layers of solution B are deposited, by following the coating/oven treatment/heat treatment sequence, on a nickel substrate whose surface has been treated as in Example 1.

This cathode, which has a NiO coating (2.2 mg/cm$^2$) has a working potential (test in the sodium hydroxide of Example 1) of −1430 mV with reference to the S.C.E.

EXAMPLE 4

A nickel substrate treated as in Example 1 is used.

A solution of 1 g of $RuCl_3.xHCl.yH_2O$ of Example 1 and 2 g of $Fe(NO_3)_3.9H_2O$ in 2 cm$^3$ of ethanol is prepared at 23° C.

Three layers of this solution are deposited on the nickel substrate by following the coating/oven treatment/heat treatment sequence of Example 1.

A 2.2 mg/cm$^2$ deposit of a mixture which shows the $RuO_2$ and $Fe_2O_3$ structures when examined by X ray crystallography is obtained.

When tested in sodium hydroxide as in Example 1, this cathode has a working potential of −1180 mV with reference to the S.C.E.

EXAMPLE 5

A nickel substrate treated as in Example 1 is used.

A solution of 1 g of $RuCl_3.xHCl.yH_2O$ of Example 1, and 2 g of $Co(NO_3)_2.6H_2O$ in 2 cm$^3$ of ethanol is prepared at 23° C.

Three layers of this solution are deposited on the nickel substrate by following the coating/oven treatment/heat treatment sequence of Example 1.

A 2.3 mg/cm$^2$ deposit of a mixture which shows the $RuO_2$ and $Co_3O_4$ structures when examined by X ray crystallography is deposited.

When tested in sodium hydroxide as in Example 1, this cathode has a working potential of −1180 mV with reference to the S.C.E.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. The process for the manufacture of a cathode having an electrically conductive substrate bearing a coating consisting essentially of at least two oxides of a metal of Group VIII of the Periodic Classification of the Elements, at least one of which is a platinum group metal and at least another of which is a nonprecious metal; comprising depositing in the form of scales onto a nonetched electrically conductive substrate at least one layer of said Group VIII metal salts from a solution or suspension, and then subjecting the whole to a heat treatment to oxidize said metal salts to the oxide form.

2. The process of claim 1, wherein all the metal salts are deposited simultaneously onto the substrate in the form of one or more layers of a solution or a suspension containing the said salts.

3. The process of claim 1, wherein in that the metal salts are deposited as successive layers.

4. The process of claims 1, 2, or 3, wherein the metal salts are halides, nitrates, carbonates, sulphates, acetates or acetylacetonates.

5. The process of claims 1, 2, or 3, wherein the heat treatment is carried out at a temperature between about 200° and 1000° C.

6. The process of claims 2 or 3, wherein the heat treatment is preceded by an oven treatment to remove at least some of the solvent or diluent from the metal salts; said oven treatment being carried out at a temperature up to about 200° C.

* * * * *